United States Patent [19]

Deveaux

[11] 4,268,002

[45] May 19, 1981

[54] MOULD FOR PACKAGING DESSERTS

[75] Inventor: Rene Deveaux, Le Raincy, France

[73] Assignee: Societe d'Assistance Technique pour Produits Nestle S.A., Lausanne, Switzerland

[21] Appl. No.: 158,892

[22] Filed: Jun. 12, 1980

[30] Foreign Application Priority Data

Jun. 21, 1979 [FR] France ..... 79 15946

[51] Int. Cl.[3] ..... B29C 1/00

[52] U.S. Cl. ..... 249/127; 249/126; 249/129; 249/130

[58] Field of Search ..... 249/119, 127, 129, 130, 249/121, 126

[56] References Cited

U.S. PATENT DOCUMENTS

| | | | |
|---|---|---|---|
| 1,948,147 | 2/1934 | Warren | 149/119 X |
| 2,296,327 | 9/1942 | Barish | 249/119 X |
| 2,446,207 | 7/1948 | Hulterstrum | 249/121 X |
| 2,666,710 | 1/1954 | Peters | 249/126 X |
| 2,961,850 | 11/1960 | Tupper | 249/130 X |
| 3,018,636 | 1/1962 | Waag et al. | 249/119 X |
| 3,306,567 | 2/1967 | Frei | 249/127 X |
| 3,625,413 | 12/1971 | Medendorf | 249/121 X |
| 3,680,828 | 8/1972 | Swet | 249/121 X |
| 3,799,493 | 3/1974 | Beck et al. | 249/121 X |
| 3,921,801 | 11/1975 | Sway | 249/121 X |
| 4,164,341 | 8/1979 | McComb | 249/126 . |

*Primary Examiner*—J. Howard Flint, Jr.

*Attorney, Agent, or Firm*—Watson, Leavenworth, Kelton & Taggart

[57] ABSTRACT

The invention relates to a mould of the type shown in FIG. 3. The mould for packaging desserts, particularly ice-cream cake with coating syrup, is in the form of a cup comprising an opening through which the dessert is introduced into and removed from the mould. The mould comprises a first compartment near the opening which defines a first space and which is intended to receive a product solid at the storage temperature and a second compartment which defines a second space below the first space and which is intended to receive a syrup liquid at the storage temperature. The second compartment comprises several cells distributed in the base of the cup, each of the cells communicating through an opening with the first compartment and being separated from the other cells by walls simultaneously acting as stiffeners for the mould.

5 Claims, 3 Drawing Figures

MOULD FOR PACKAGING DESSERTS

This invention relates to the packaging of desserts and, more particularly, to the packaging of ice cream, ices, sorbets or the like comprising a coating syrup.

The present trend in the field of desserts, particularly ice-cream cake, is to provide the consumer with a ready-made product, for example an ice-cream cake with coating syrup which may be directly prepared by removal from the mould used for packaging.

Packs for products of this type are already known. However, with such packs it is generally necessary, after the cake has been removed from the mould, to coat it separately with syrup which has itself been separately packaged.

One-piece packs have also been proposed, comprising a first compartment which receives the ice cream and a second compartment which contains the syrup. However, these known packs generally contain individual portions.

Now, it would be desirable to make available to the public a pack of fairly large dimensions, for example a family-size pack, for an ice-cream cake with coating syrup. However, this involves difficulties, particularly so far as the filling operation is concerned, because a distinct separation is required between the syrup and the ice cream. During production, the mould with its opening facing upwards is initially filled with syrup to a certain level, the filling then being completed by the ice cream. Now, if the dimensions of the mould and the compartments are large, it is very difficult to obtain a distinct separation between the ice cream and the syrup. The pack according to the invention obviates these difficulties.

Accordingly, the present invention provides a mould for packaging desserts, particularly for ice-cream cake with coating syrup, in the form of a cup comprising an opening through which the dessert is introduced into and removed from the mould, the mould comprising a first compartment near the opening which defines a first space and which is intended to a receive a product solid at the storage temperature and a second compartment which defines a second space below the first space and which is intended to receive a syrup liquid at the storage temperature, the second compartment comprising several cells distributed in the base of the cup, each of the cells communicating through an opening with the first compartment and being separated from the other cells by walls simultaneously acting as stiffeners for the mould. The first compartment is provided with a ledge which surrounds the various openings establishing communication with the second compartment and which is parallel to the edge of the opening of the cup.

In one preferred embodiment of the mould according to the invention, the side wall of the cup is corrugated and comprises from six to twelve festoons, whilst the second compartment comprises a cylindrical central cell and six to twelve cells which are distributed around the periphery of the central cell and of which the shape matches that of the lateral festoons. Accordingly, the base of the mould is made up of a number of cells separated by stiffeners which also form partitions between the cells. This arrangement has the following advantages:

It enables the pocket of syrup to be partitioned off, thus increasing its imperviousness during the storage and distribution period.

It enables the pressure of the ice-cream on the surface of the syrup during filling to be divided, thus avoiding random penetration during distribution of the still soft ice-cream in the container. Finally, it enables the appearance of the product on removal from the mould to be improved by impressing on the surface of the ice-cream a pattern which matches that of the lateral festoons. In its preferred form, the mould has a diameter at the level of the opening of from 120 to 170 mm, the syrup pockets preferably measure from 10 to 25 mm, the volume of ice cream is from 750 to 1200 ml, whilst the volume of syrup is from 75 to 150 ml, and the central cell may contain from 10% to 20% of the total volume of syrup.

The mould according to the invention may be used for all kinds of products made in moulds other than ice cream, such as caramel puddings, semolina pudding, rice pudding, jellies with syrup or mousses with syrup etc. However, it is pointed out that, for any product which is packaged at low temperature or which undergoes a heat treatment below 120° C. after packaging, the mould is best made of a plastics material. It is possible to use any heat-formable food-grade plastics material, such as for example polyvinyl chloride, polypropylene, polyethylene, polystyrene, etc.

For a product which undergoes a heat treatment at a temperature of or higher than 120° C., it is advantageous to use stamped aluminum.

The material used should be of such thickness that it is sufficiently rigid whilst, at the same time, having the flexibility required to facilitate removal from the mould. In addition, it should be capable of withstanding prolonged storage at low temperatures.

The features and advantages of the invention will become apparent from the following description in conjunction with the accompanying diagrammatic drawings given by way of example, wherein.

Figure 1:
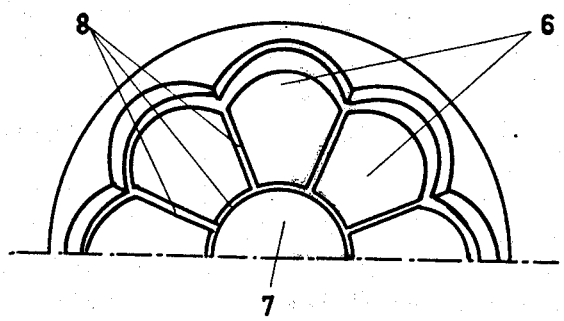
FIG. 1 is a semi-plan view.
Figure 2:
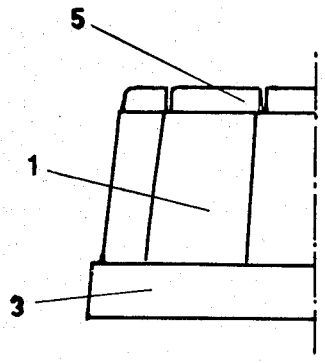
FIG. 2 is a semi-elevation.
Figure 3:
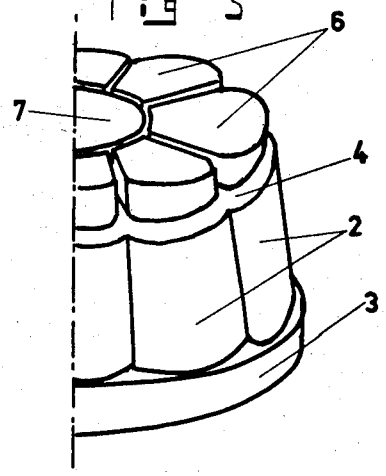
FIG. 3 is a semi-isometric projection of the mould.

Generally and as can be seen from the drawings, the pack according to the invention comprises a first compartment 1 of which the side wall is provided with festoons 2 and the widest part with a base 3. The first compartment is provided with a ledge 4 and is intended to receive that part of the dessert which is solid at the storage temperature, for example the ice cream. The mould comprises a second compartment 5 which is intended to receive that part of the dessert which is liquid at the storage temperature, for example the coating syrup.

This second compartment is made up of cells 6 arranged in a circle around a central cell 7. These cells are separated from one another by walls 8 which act as stiffeners for the base of the mould.

The mould may be made in one piece of a thermoplastic material by forming or extrusion or, in the case of aluminium, by stamping.

For filling, a syrup which has a consistency sufficient not to cause any flow problems during storage and transport, for example at −20° C., but which has to be capable of re-assuming a suitable fluidity at the moment of use by heating for a sufficiently short period not to cause the underlying ice cream to melt, is poured into the cells 6 and 7 at the bottom of the mould with its opening facing upwards up to the level of the ledge 4. The syrup may be either a mixture of fruit juice and sugar or a caramel or even a flavoured syrup, for example a coffee-flavoured or chocolate-flavoured syrup, of suitable viscosity. The mould is then directed towards a filling station which introduces the ice cream into the first compartment 1.

It is possible to use one or more types of ice cream, water ice, mousse or any suitable type of cream. Where several types are present, they may be arranged either in the form of superposed layers or in the form of concentric rings or in the form of radial sections.

At the moment of use, the mould is inverted and heated so that the ice cream detaches itself from the mould and the coating syrup flows along its sides, for example on a plate. However, when the product accommodated in the first compartment is not frozen or has a certain plasticity, for example in the case of a pudding, it may be removed from the mould by simple deformation of the mould.

I claim:

1. A mould for packaging desserts, particulary for ice-cream cake with coating syrup, in the form of a cup comprising an opening through which the dessert is introduced into and removed from the mould, the mould comprising a first compartment near the opening which defines a first space and which is intended to receive a product solid at the storage temperature and a second compartment which defines a second space below the first space and which is intended to receive a syrup liquid at the storage temperature, the second compartment comprising several cells distributed in the base of the cup, each of the cells communicating through an opening with the first compartment and being separated from the other cells by walls simultaneously acting as stiffeners for the mould.

2. A mould as claimed in claim 1, wherein the lateral wall of the cup is corrugated and comprises from six to twelve festoons.

3. A mould as claimed in claim 1, wherein the first compartment is provided with a ledge which surrounds the various openings establishing communication with the second compartment and which is parallel to the edge of the opening of the cup.

4. A mould as claimed in claim 2, wherein the second compartment comprises a cylindrical central cell and from six to twelve cells which are distributed around the periphery of the central cell and of which the shape matches that of the lateral festoons.

5. A mould as claimed in any of the preceding claims, wherein the first compartment has a volume of from 750 to 1200 ml and the second compartment has a volume of from 75 to 150 ml.

* * * * *